US009550555B2

(12) United States Patent
Ulgen

(10) Patent No.: US 9,550,555 B2
(45) Date of Patent: Jan. 24, 2017

(54) PROPELLER ARRANGEMENT FOR MARINE VEHICLES

(71) Applicant: Mehmet Nevres Ulgen, Istanbul (TR)

(72) Inventor: Mehmet Nevres Ulgen, Istanbul (TR)

( * ) Notice: Subject to any disclaimer, the term of this patent is extended or adjusted under 35 U.S.C. 154(b) by 515 days.

(21) Appl. No.: 14/103,278

(22) Filed: Dec. 11, 2013

(65) Prior Publication Data

US 2015/0139801 A1 May 21, 2015

(30) Foreign Application Priority Data

Nov. 15, 2013 (TR) ..... u 2013 13304

(51) Int. Cl.
*B63H 1/26* (2006.01)
*B63H 1/20* (2006.01)

(52) U.S. Cl.
CPC . *B63H 1/26* (2013.01); *B63H 1/20* (2013.01)

(58) Field of Classification Search
CPC ..... B63H 1/14; B63H 1/20; B63H 1/26; B63H 5/07; F01D 5/025; F01D 5/027; F01D 5/14; F01D 5/22; F01D 5/30; F04D 29/20; F04D 29/322; F04D 29/34
USPC ..... 416/244 B, 219 A, 220 A, 245 A, 204 R, 416/212 R
See application file for complete search history.

(56) References Cited

U.S. PATENT DOCUMENTS

| | | | | |
|---|---|---|---|---|
| 3,791,762 A * | 2/1974 | Brehme | B63H 1/28 | 416/198 R |
| 6,176,680 B1 * | 1/2001 | Ringblom | B63H 1/20 | 416/212 A |
| 2012/0114489 A1 * | 5/2012 | Ulgen | B63H 1/26 | 416/214 R |
| 2012/0141201 A1 * | 6/2012 | Anderson, III | F16D 1/094 | 403/374.4 |

* cited by examiner

*Primary Examiner* — Craig Kim
*Assistant Examiner* — Juan G Flores
(74) *Attorney, Agent, or Firm* — Vidas, Arrett & Steinkraus, P.A.

(57) ABSTRACT

The present invention relates to a marine propeller arrangement comprising a propeller communicating with a shaft connected to the motor of a marine vehicle, the propeller having a hub and demountable blades, wherein each blade comprises a hub portion being integral with each blade and having plurality of bores for securing thereof; and the arrangement comprises a sleeve having a shaft receiving bore, wherein each hub portion is supported by the sleeve and secured thereto via a plurality of securing elements.

12 Claims, 9 Drawing Sheets

PROPELLER ARRANGEMENT FOR MARINE VEHICLES

CROSS-REFERENCE TO RELATED APPLICATIONS

This application claims priority to Turkish application 2013/13304 filed on Nov. 15, 2013

STATEMENT REGARDING FEDERALLY SPONSORED RESEARCH

Not applicable.

BACKGROUND OF THE INVENTION

The present invention relates to a propeller arrangement comprising a propeller with individual blades to be joined on a sleeve.

Thrust required for the movement of marine vehicles capable of traveling on the water such as boats, ships or capable of traveling under water such as submarines is provided by the propeller. Propellers generally comprise a hub portion and a plurality of blades connected to the hub. Surfaces of the propeller blades are generally provided with a helicoidal form and pressure is created by the compression of fluid, water, on the helicoidal surface after it is captured by the leading edge of the blade, then it accelerates over the blade and exits from the trailing edge. The path followed by the fluid over the blade and compression amount connected thereto affects the magnitude of the resulting thrust.

Propellers are conventionally cast in monolithic form and produced by being machined. In other words, blades are produced monolithic to the hub. This monolithic structure has some disadvantages. A). Blades cannot overlap each other for the removal of the propellers generally cast as a single piece from the mold and surface machining thereof and they can hardly exceed a surface area ratio of 1:1, remaining generally below the value of 1 (For example: 0.950, etc.). B). If one of the blades is damaged due to mechanical fatigue, external impact or any other reason, the entire propeller is discarded. In addition, the blades should be provided along the thickness of the hub (i.e. the depthwise direction of the hub) in order to achieve maximum thrust from the blades arranged radially around the hub. Production costs of a very sensitive structure with such a complex geometry are high, because it requires detailed planning during and prior to the operation, benches or machines meeting the diameter of the entire propeller are required to be enormous and expensive units for fulfilling the size limits thereof.

There are known marine propellers having blades detachably connected to each other by securing mechanisms such as bolts. In this type of propellers, detachable blades are usually mounted and secured on the external surface of a cylindrical hub. Thus, hubs and blades are separately produced and then mounted for each separate boat. On the other hand, it is difficult to ensure a safe blade connection in the propellers with detachable blades. Blade connections can weaken over time.

For example, propellers with blades detachably secured to the hub are disclosed in the documents US2008/0166933, the entire contents of which is incorporated herein by reference, U.S. Pat. No. 6,537,031, the entire contents of which is incorporated herein by reference, and GB2328251A, the entire contents of which is incorporated herein by reference. Also, in the document JP 1237068, the entire contents of which is incorporated herein by reference, blades forming a propeller by means of a middle hub portion and manufacturing method of said blades and separate molding of the propeller blades are disclosed.

Propellers with detachable blades are also known in the prior art, wherein each blade is partially integral with a portion of the hub. For example, US2012114489, the entire contents of which is incorporated herein by reference, discloses a propeller with blades mountable to each other and partially comprising a portion of the hub at the joining end of the blades is disclosed. The propeller of US2012114489 should be separately designed for each separate vessel shaft and the rigidity of the blade connections is debatable.

BRIEF SUMMARY OF THE INVENTION

An object of the present invention is to provide a propeller arrangement which is easily adaptable to the marine vehicle shaft, with having improved connection rigidity.

The present invention relates to a marine propeller arrangement comprising a propeller communicating with a shaft connected to the motor of a marine vehicle, the propeller having a hub and demountable blades, characterized in that each blade comprises a hub portion being integral with each blade and having plurality of bores for securing thereof; and the arrangement comprises a sleeve having a shaft receiving bore, wherein each hub portion is supported by the sleeve and secured thereto via a plurality of securing members.

Each blade hub portion can be secured by a common securing element together with a previous and a subsequent blade hub portion. Thus, connection rigidity of the resulting propeller is made more rigid compared to known propeller shaft connections.

The sleeve according to the present invention comprises a cylindrical portion, wherein the body portion integral with each blade is secured thereto and a cylindrical hub supporting portion extending axially from the cylindrical portion, wherein each body portion is seated thereon. The sleeve according to the present invention is seated on the shaft and particularly on the tapered portion of the shaft connected to the motor of a marine vehicle. Thus, the through bore of the sleeve is tapered.

The propeller arrangement according to the present invention further comprises a connection collar that can be attached to the other end of the hub supporting portion (the other end without integral cylindrical portion). The connection collar is connected to the hub portions disposed on the blades at the other ends thereof.

BRIEF DESCRIPTION OF THE SEVERAL VIEWS OF THE DRAWINGS

Embodiment of the present invention and advantages thereof with the additional components should be considered together with the figures explained below in order to be fully understood.

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated.

Figure 1:
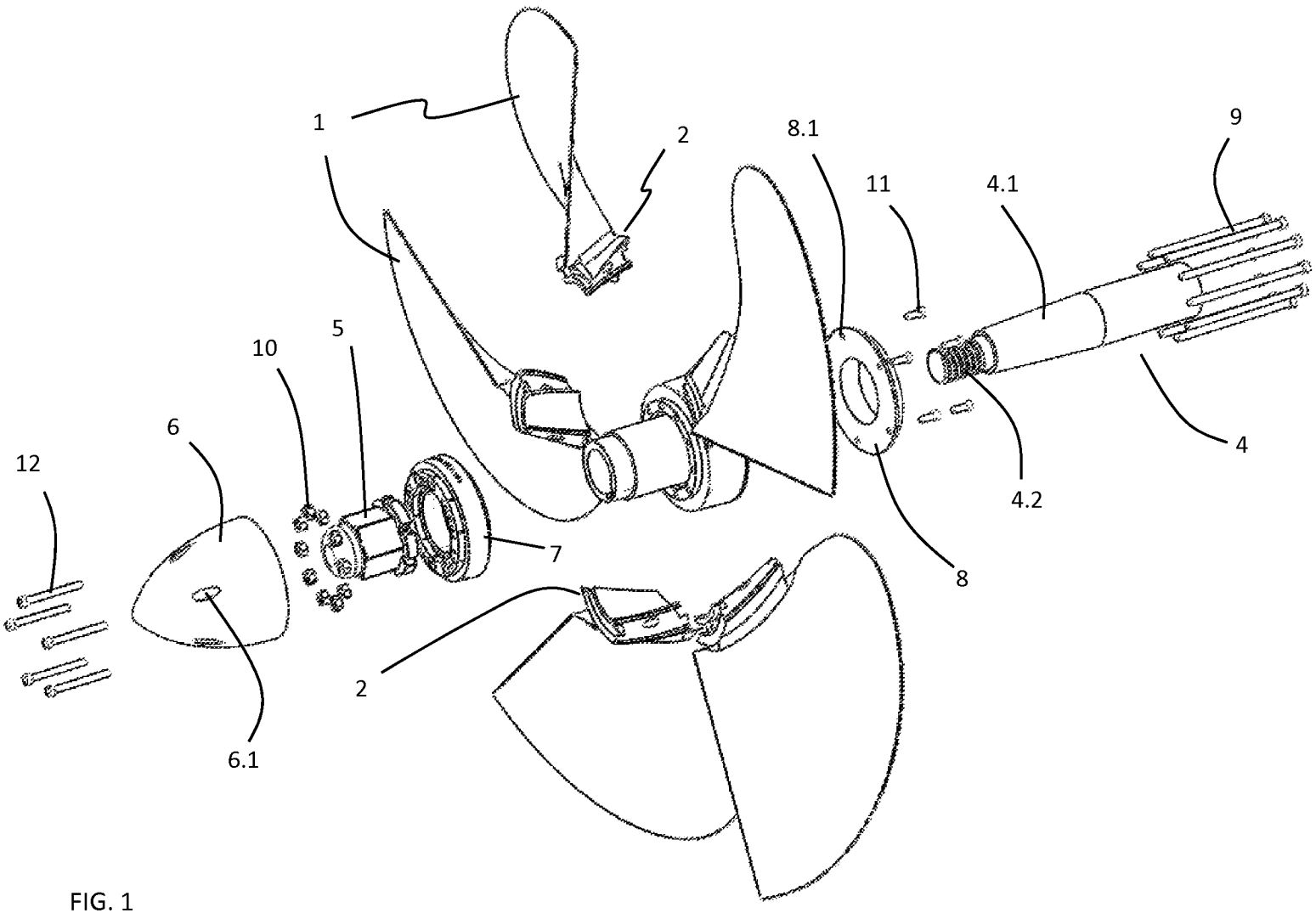
FIG. 1 shows an exploded view of the propeller arrangement according to the present invention with a shaft.
Figure 2:
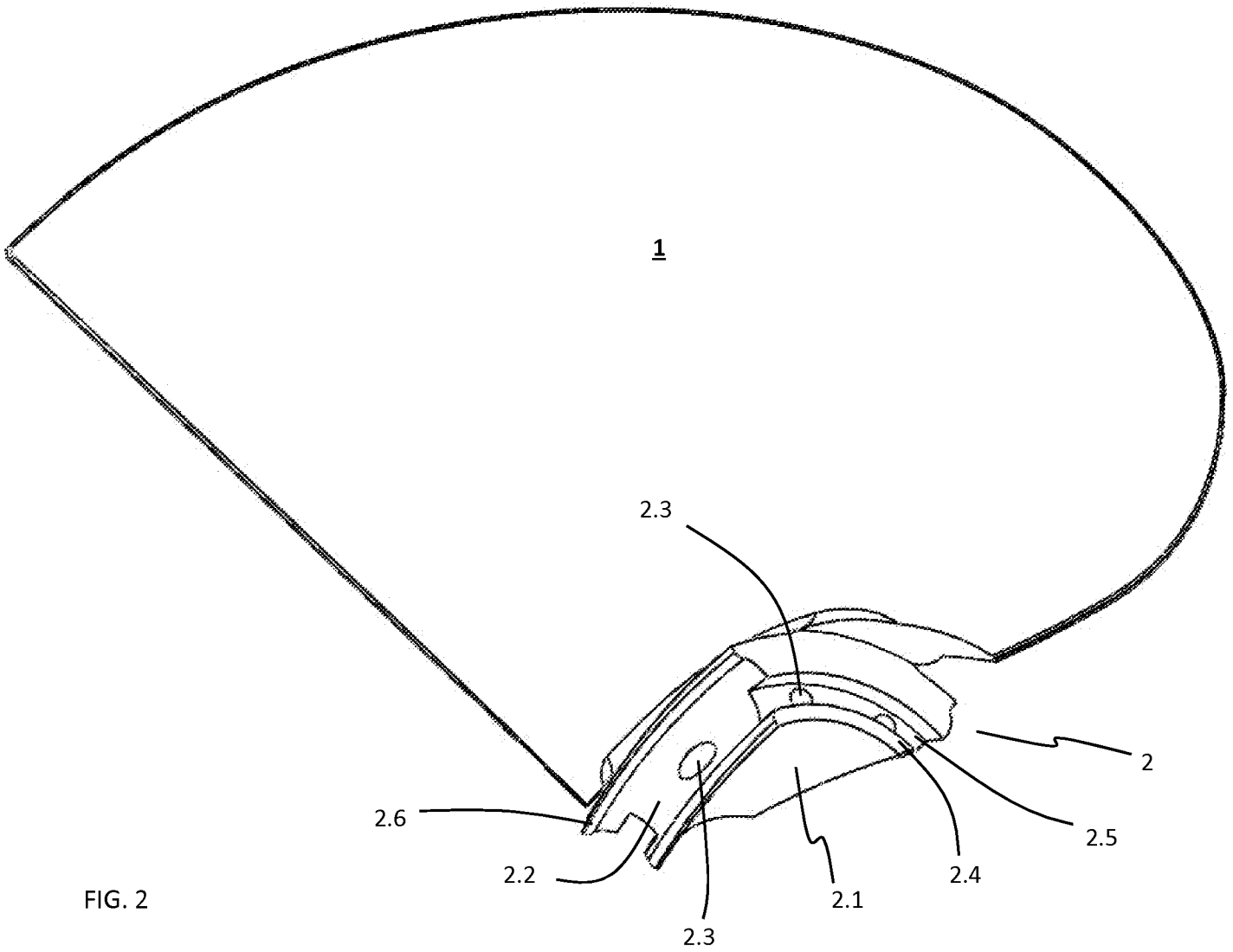
FIG. 2 shows a propeller blade.

As seen in FIG. 1, the propeller arrangement according to the present invention comprises a propeller having a plurality of demountable blades (1) and a sleeve (3) for fitting the propeller thereon. As seen in FIG. 2, each blade (1) comprises a hub portion (2) integral therewith, thus, when the blades (1) are assembled, the hub portions (2) define the entire propeller hub.

Each hub portion (2) arcuately extends along the lower edge of the respective blade (1). Each hub portion (2) comprises a sleeve seating surface (2.1) on the lower portion thereof. The sleeve seating surface (2.1) has a form such that it is perfectly compatible with the form of the sleeve outer surface so as to fit on the outer surface of the sleeve (3) as will be described later. Each hub portion's (2) lateral surfaces extending along the hub portion define a first and a second mating surface (2.2). Mating surfaces (2.2) extend oppositely and having arcuate form. A mating surface of a blade is formed to ensure a perfect mating compatibility with the mating surface of the subsequent blade.

According to the preferred embodiment of the present invention, the first mating surface (2.2) comprises mating surface protrusions (2.6) extending outwardly from the surface and the second mating surface (2.2) comprises mating surface recesses (2.7) extending inwardly from the surface. Thus, when the blades (1) are joined, the mating surface (2.2) of a blade with protrusions (2.6) mates with the mating surface (2.2) of the subsequent blade with recesses (2.7). According to the preferred embodiment of the present invention, joining the blades (1) together is provided by means of putting an end of the mating surface (2.2) with surface recess (2.7) in an end of the mating surface with surface protrusion (2.6) and sliding thereof along the mating surface (2.2).

Figure 3:
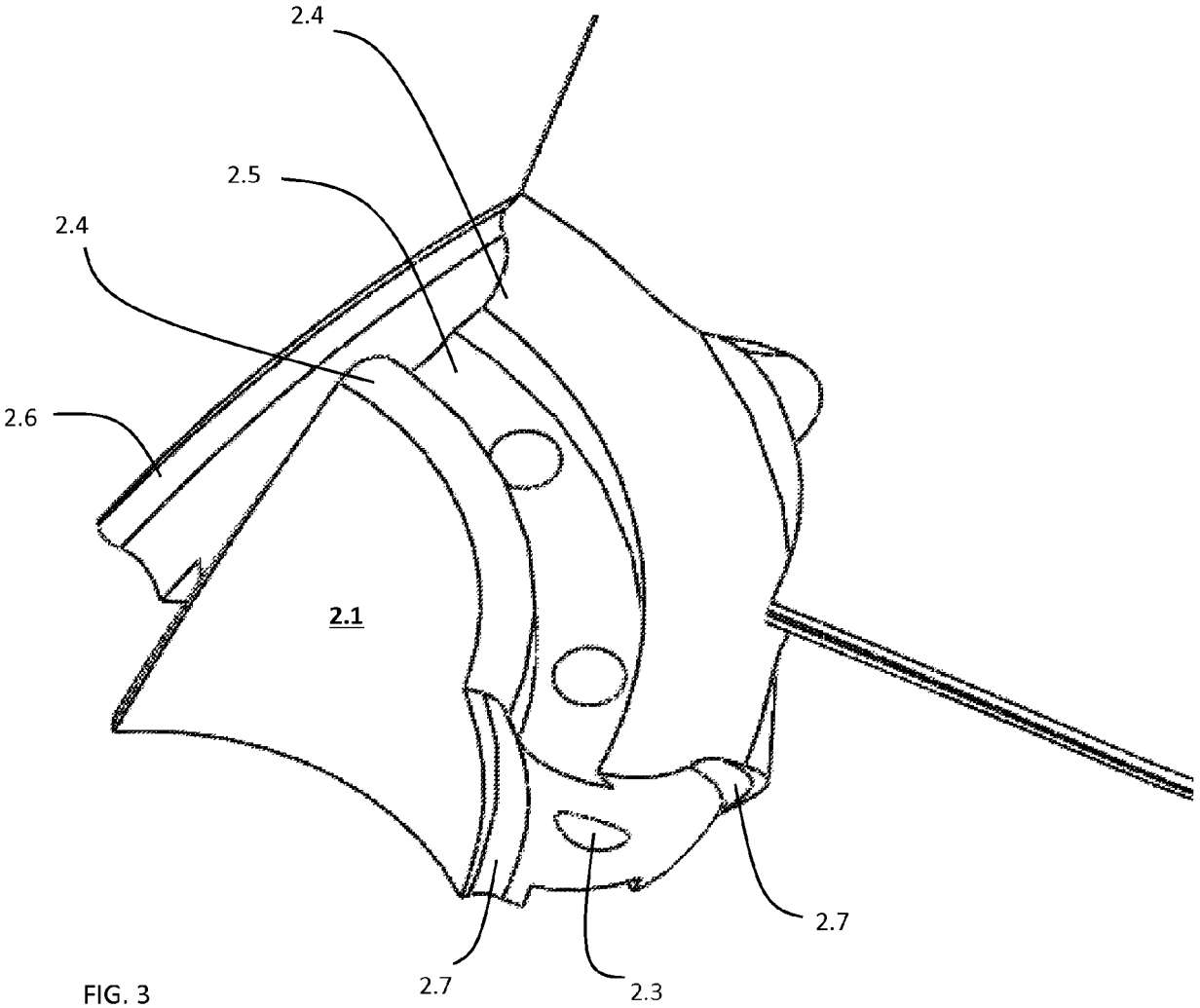
FIG. 3 shows the hub portion of a propeller blade.

Each hub portion (2) comprises a hub recess (2.5) extending circumferentially in the shaft radial direction. The hub recess (2.5) forms two hub protrusions (2.6) spaced radially along the thickness of the hub portion (2). Hub securing bores (2.3) linearly formed parallel to the shaft axis along the length of the hub portion (2) starting from the surface of each hub recess (2.5) are formed. Since mating surfaces (2.2) of each hub portion (2) comprise an arcuate form, a hub securing bore (2.3) drilled on the surface of the hub recess (2.5) can make an open to a mating surface (see FIG. 3). In such a case, mating surface of the subsequent blade to be mated to said mating surface is also provided with a hub securing bore (2.3), thus, continuity of the bore parallel to the shaft axis is ensured.

According to the preferred embodiment of the present invention, one common hub securing element (9) is used for securing more than one blade hub portion (2). In particular, a blade hub portion (2) of each propeller is secured with a previous and a subsequent blade hub portion (2) by a common hub securing elements (9). According to the preferred embodiment, each hub portion (2) is secured by means of three hub securing elements (9). Among these securing elements, the one in the middle connects only one hub portion to the sleeve (3) while the other securing elements (disposed on the two ends) connect three different hub portions (2) to the sleeve (3). Namely, since the blade hub portion (2) fits so as to be below and above the previous and subsequent blade hub portion (2), a hub securing element (9) introduced through the hub securing bore (2.3) on the front end of the hub portion (2) remaining in the upper part passes through the middle of the mating surface (2.2) of the hub portion remaining in the lower part and exits through the hub securing bore (2.3) at the rear end of the hub portion. In other words, a single hub securing element (9) thus connects three hub connection portions to each other.

Figure 6:
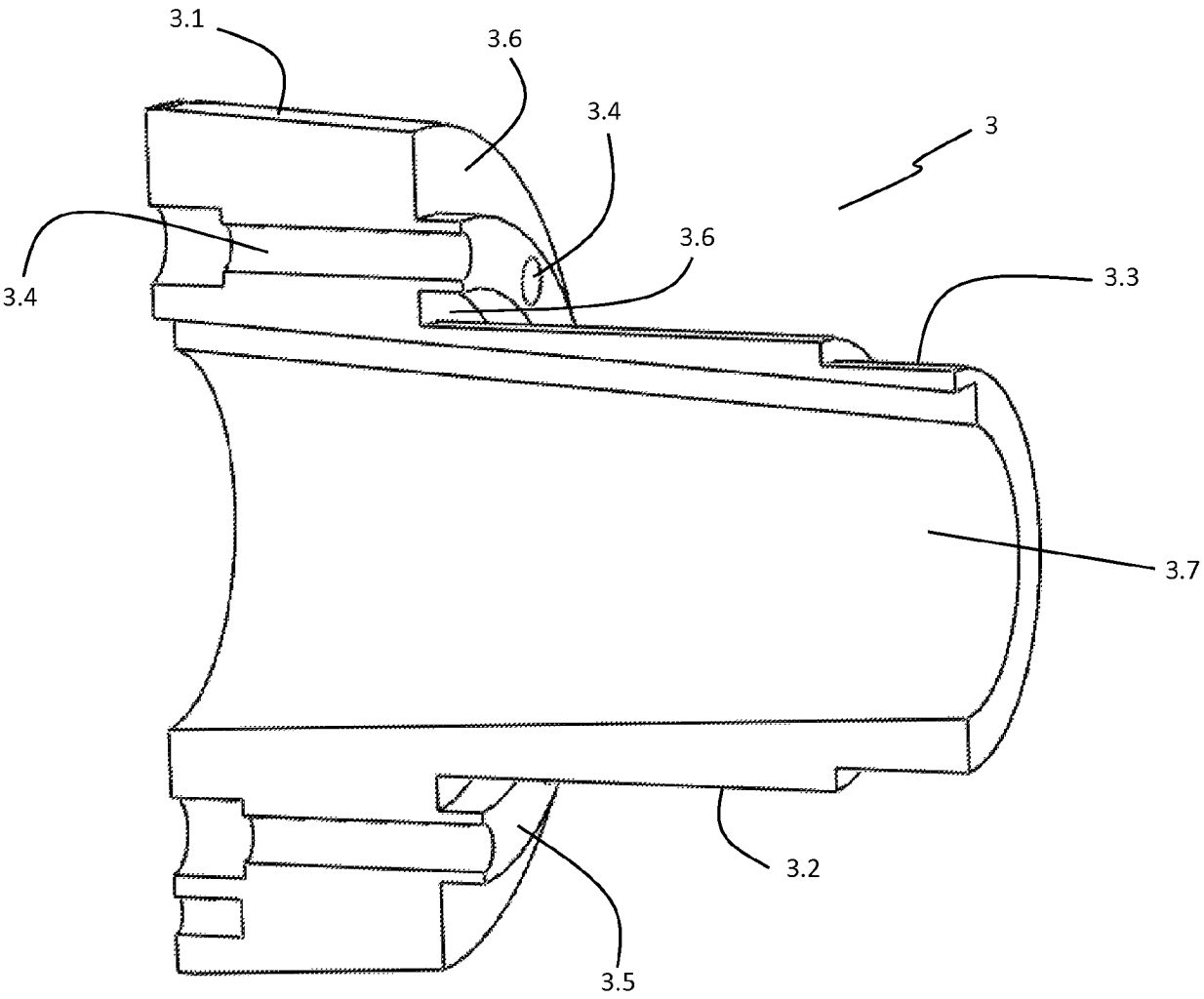
FIG. 6 shows a cross sectional perspective view of the propeller arrangement sleeve.

The hub portions (2) are seated on the sleeve (3) as seen in FIG. 6. The sleeve (3) comprises a cylindrical portion (3.1) having a relatively bigger diameter, and a hub supporting portion (3.2) extending axially therefrom. Sleeve seating surface (2.1) of each hub portion (2) is seated on the cylindrical outer surface of the hub supporting portion (3.2). The cylindrical portion (3.1) of the sleeve (3) comprises a circular sleeve protrusion (3.5) being coaxial thereto and extending axially along the hub supporting portion (3.2). The sleeve protrusion (3.5) is sized so as to enter into the hub recess (2.5) disposed on each hub portion. When the hub portions (2) are fitted on the sleeve (3), the hub protrusions (2.4) provided on the hub portions (2) go into the sleeve recesses (3.6) formed by means of the sleeve protrusion (3.5) on the sleeve face. These sleeve recesses (3.6) have a circular form.

The cylindrical portion (3.1) of the sleeve comprises sleeve securing bores (3.4) extending through the thickness thereof. These bores (3.4) start from the rear face (3.11) of the sleeve and end at the sleeve protrusion (3.5) and sleeve securing bores (3.4) overlap the hub securing bores (2.4) so as to be in the same direction.

The sleeve (3) is seated on the shaft (4), particularly on the tapered surface (4.1) of the shaft connected to the motor of a marine vehicle. Thus, the shaft bore of the sleeve is tapered to be compatible with the tapered surface (4.1) of the shaft. Therefore, adaptation of the propeller to the shaft (4) is easily achieved by modifying the sleeve shaft bore (3.7) or by simply changing the sleeve (3) without changing the blades (1) for shafts having different sizes or tapers.

Figure 7:
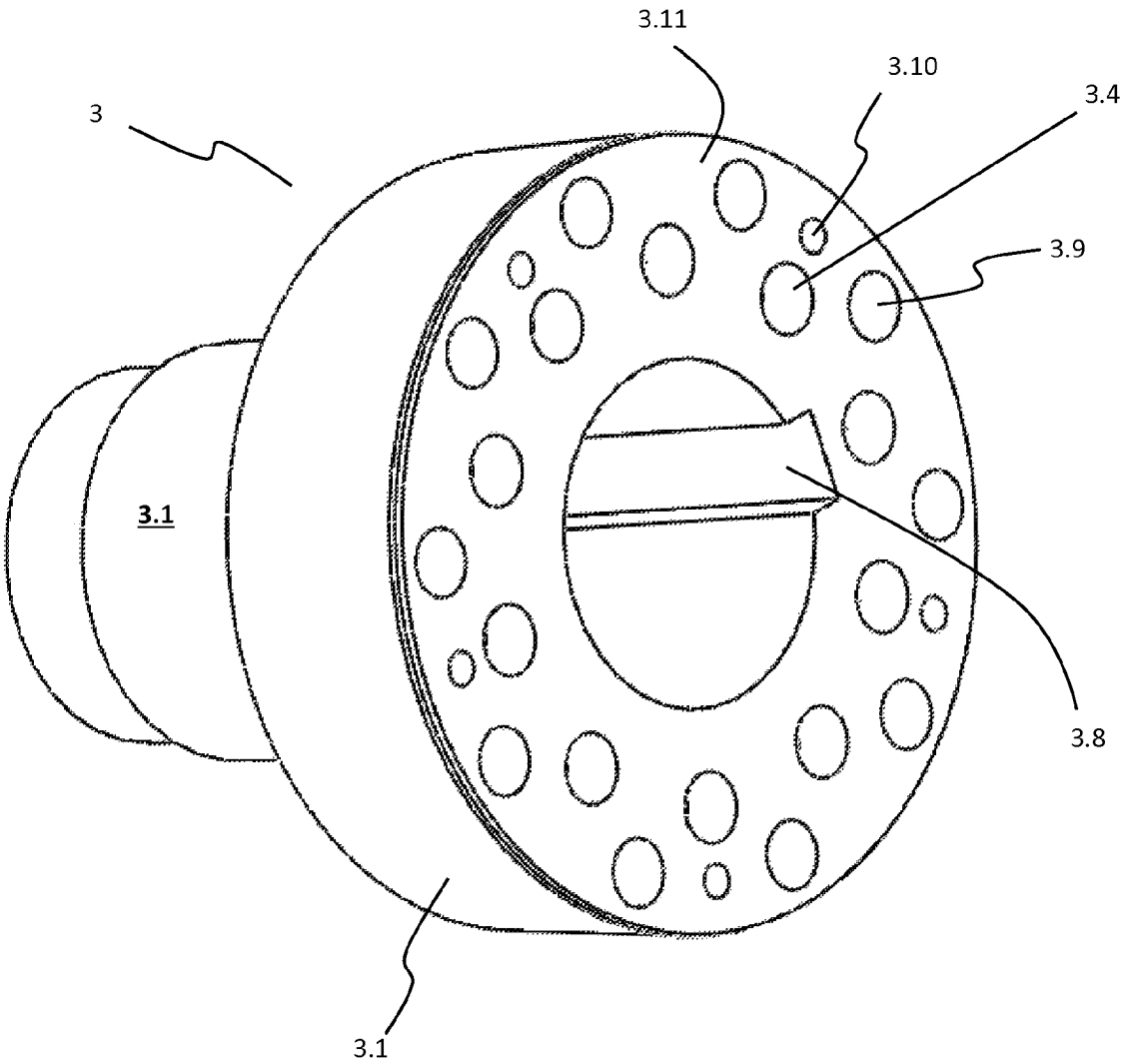
FIG. 7 shows a rear view of the sleeve.

As seen in FIG. 7, a wedge channel (3.8) is formed on the inner surface of the sleeve shaft bore (3.7) and a counter channel is formed on the shaft (4) (not shown), thus, power transmission from the shaft (4) to the sleeve (3) is provided by means of a wedge placed into the wedge channel (3.8). Apart from the sleeve securing bores (3.4), other bores or openings are provided on the rear face (3.11) of the sleeve. Some of these are mass balancing openings (3.9) extending along the thickness of the sleeve cylindrical portion (3.1). Mass balancing opening (3.9) can be filled with a mass in order to compensate for centrifugal force that can result from possible mass difference on a blade.

The sleeve rear face (3.11) is covered with a sleeve plate (8) having a rounded rear face so as to reduce hydrodynamic losses when the propeller is in use. The sleeve plate (8) is connected to the sleeve rear face (3.11) by plate connection bolts (11) which are screwed after being passed through the sleeve plate bolt bores and plate connection bolt openings (3.10).

Figures 8A, 8B:
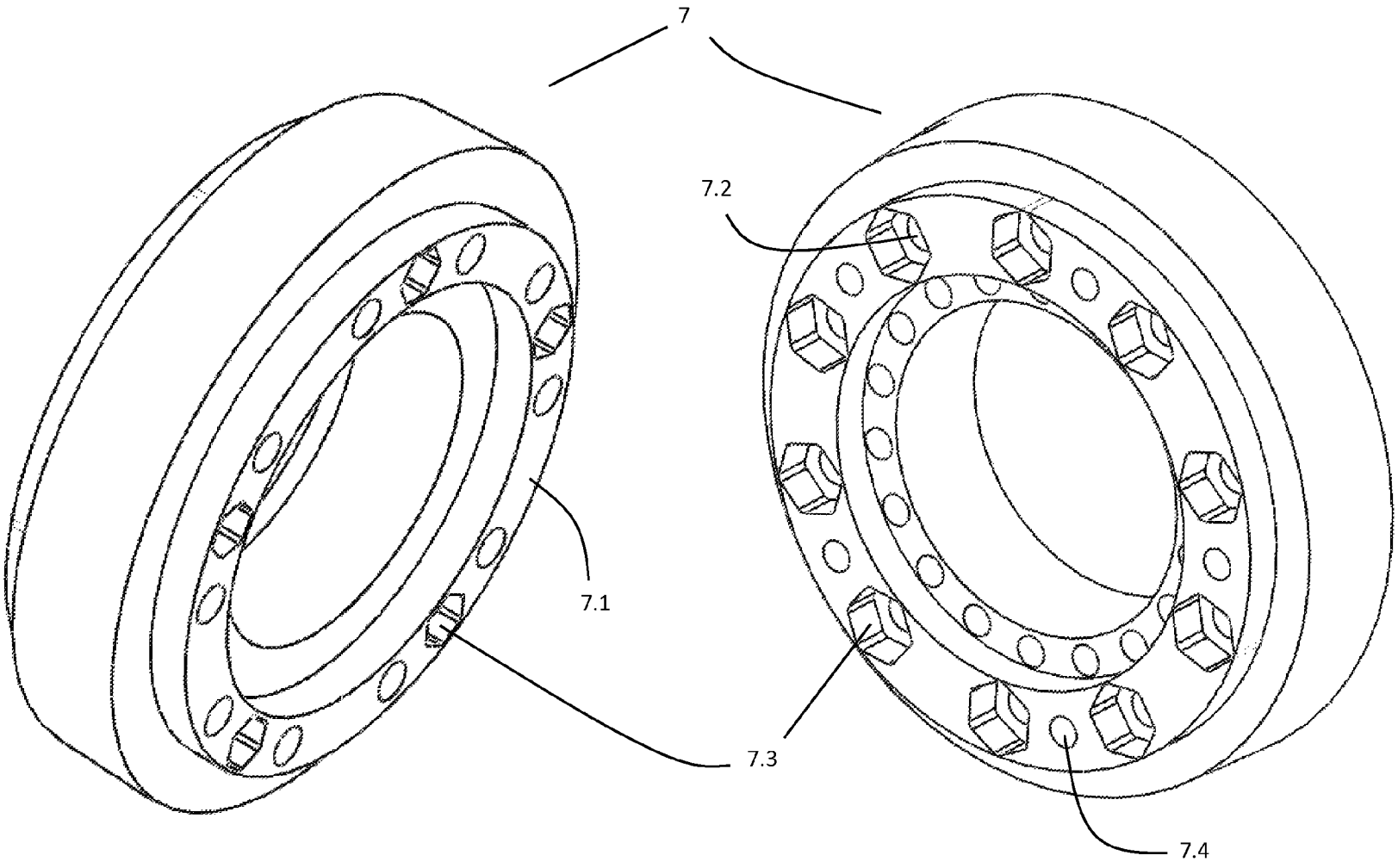
FIG. 8A shows the connection collar.
FIG. 8B shows the connection collar from another angle.
Figure 9:
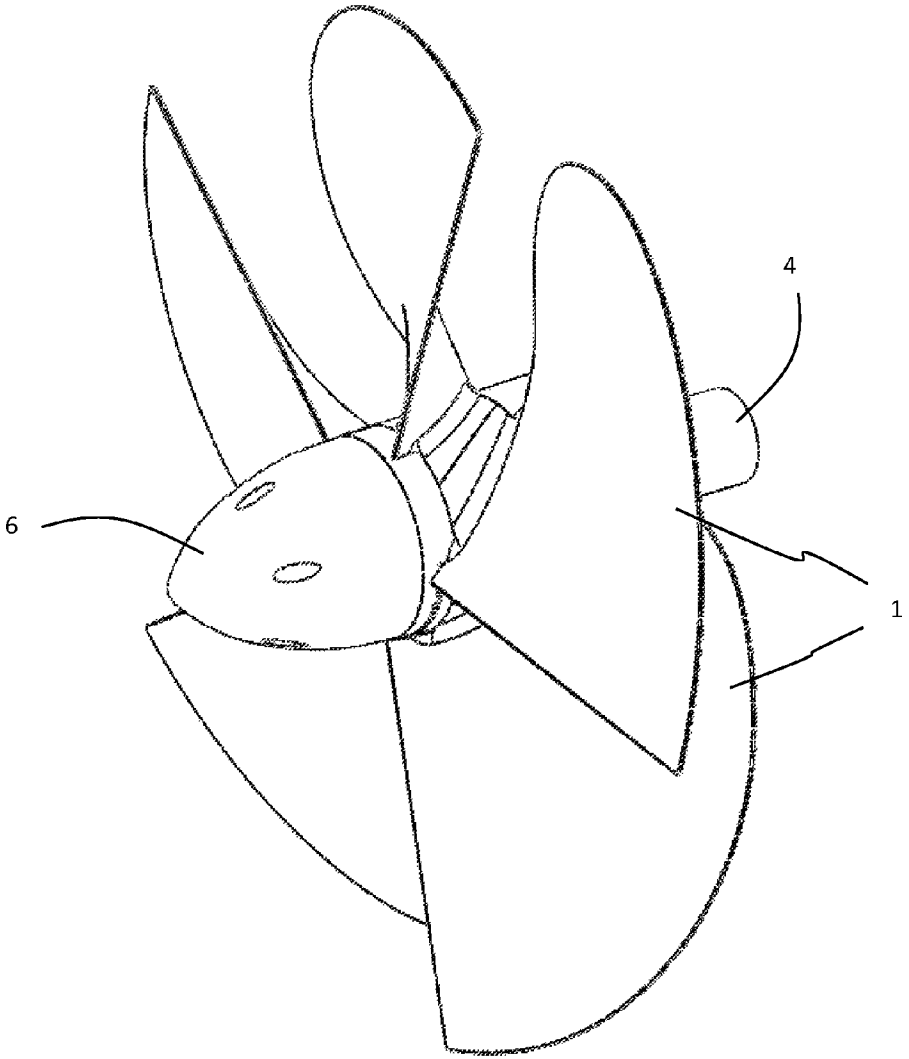
FIG. 9 shows the mounted propeller arrangement.

A cylindrical collar supporting portion (3.3) is formed at the end of the hub supporting portion (3.2) of the sleeve (3). The diameter of the collar supporting portion (3.3) is smaller than the diameter of the hub supporting portion (3.2). A connection collar (7) is fitted as shown in FIGS. 8A and 8B on the collar supporting portion (3.3). The connection collar (7) comprises circular connection collar protrusions (7.1) protruding axially on both opposing circular surfaces thereof. The connection collar (7) also comprises connection collar bores (7.2) extending along the thickness thereof, wherein the bores (7.2) are preferably formed along the connection collar protrusions (7.1). The connection collar (7) is connected to the other part of the hub portions (2) (to the part not provided with the sleeve cylindrical portion). Indeed, hub recesses (2.5) and hub protrusions (2.4) are also provided on the other face surfaces of the hub portions (2). Thus, the blade hub portions (2) and so blades (1) are connected to the sleeve cylindrical portion (3.1) on one side and to the collar (7) on the other side.

Connection collar bores (7.2), hub securing bores (2.3) and sleeve securing bores (3.4) are aligned in the same direction during mounting and the relevant components are connected to each other by passing a securing element (9) such as a bolt or the like through said bores. Nut slots (7.3) are formed on the connection collar protrusion (7.1) and after the securing element (9) are passed through the sleeve securing bores (3.4), hub securing bores (2.3) and connection collar bores (7.2), the hub is tightened with securing nuts (10) and loosening thereof is prevented.

Figure 4:
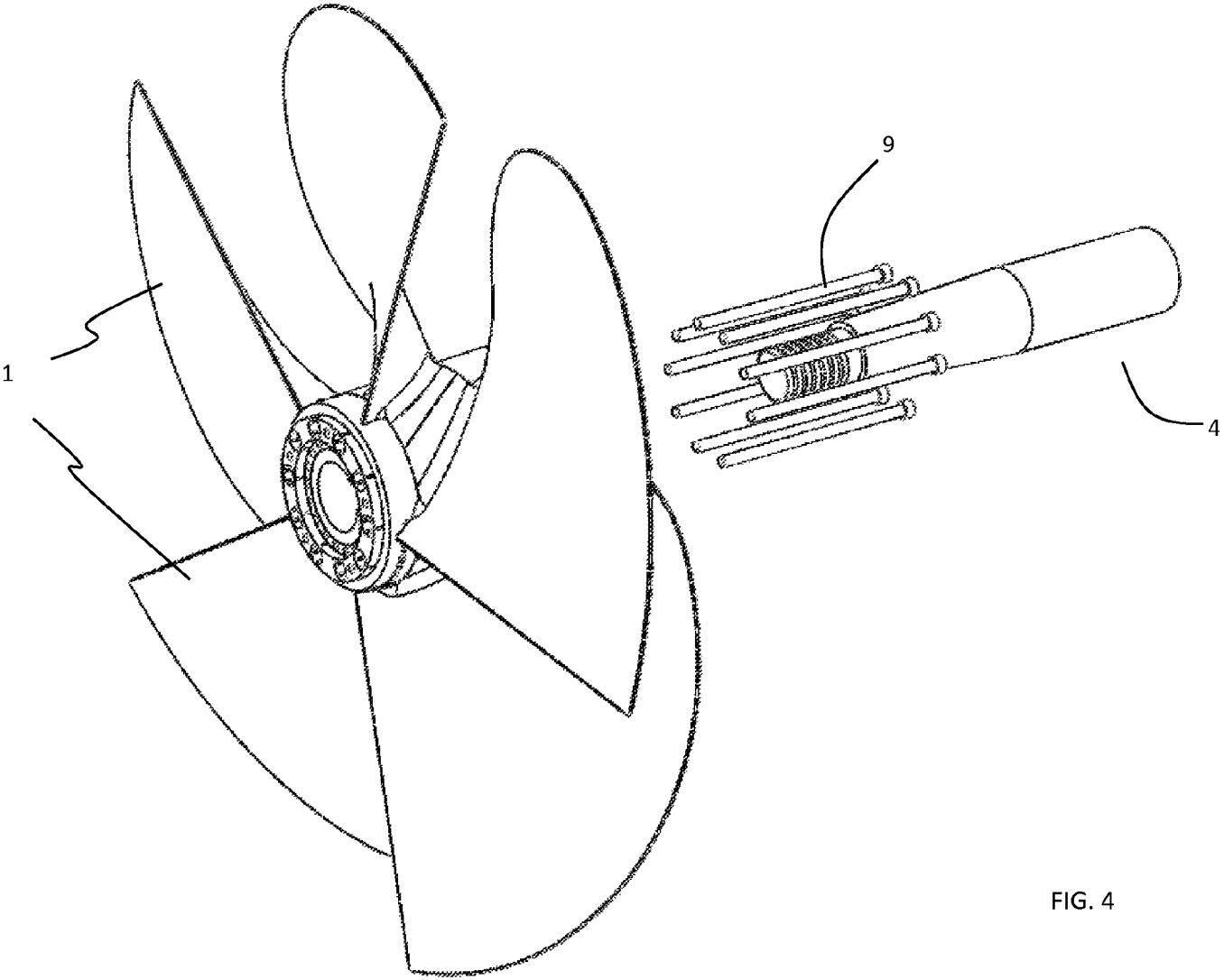
FIG. 4 shows the propeller and shaft.
Figure 5:
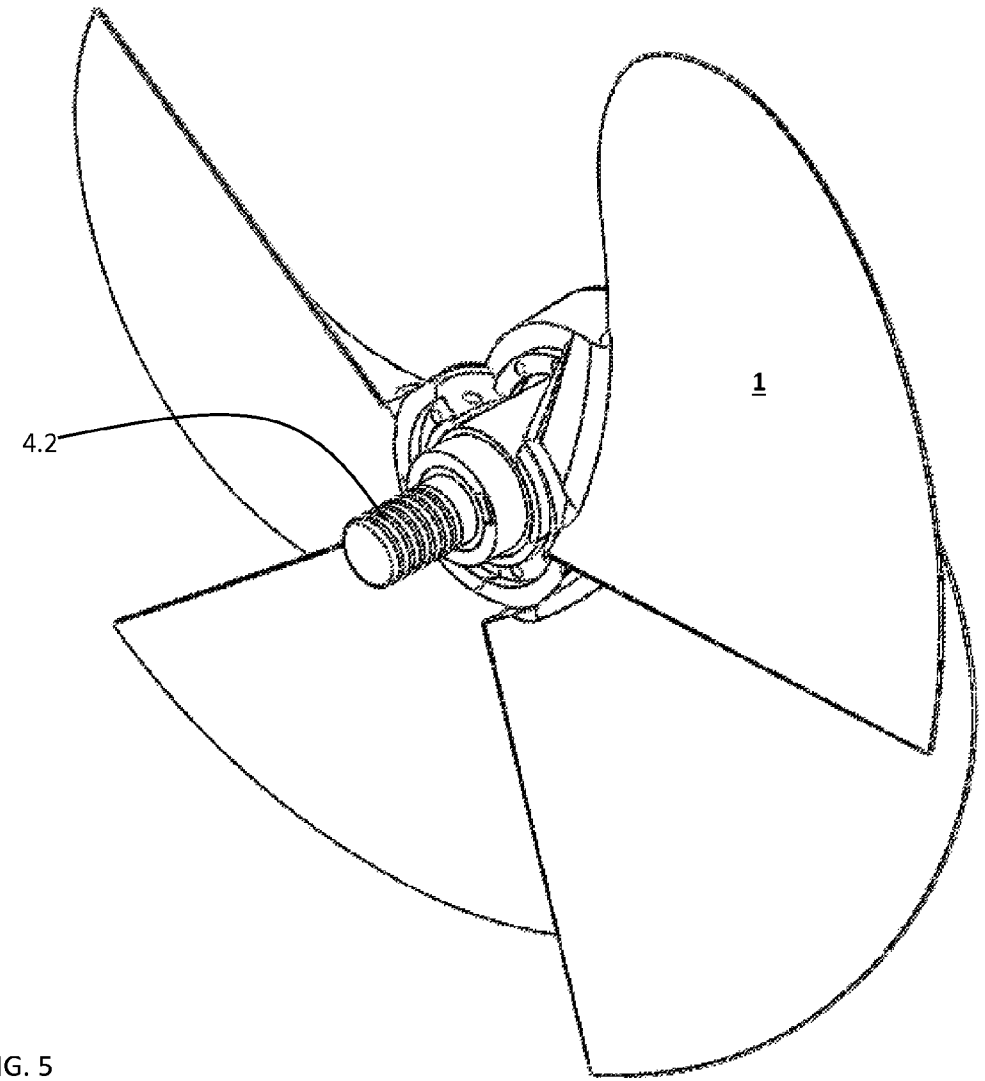
FIG. 5 shows the propeller with a removed blade.

As seen in FIG. 4, the propeller arrangement, after being mounted, is fitted on the shaft, then hub securing elements (9) are passed through the sleeve securing bores, hub securing bores and connection collar bores and nut connections are made on the connection collar through the ends thereof. Afterwards, a shaft nut (5) is attached on the threads provided on the end portions of the shaft. A tapered hub housing (6) is provided on the shaft nut (5). The tapered hub housing (6) comprises a structure tapering gradually towards the front, thus, minimization of the hydrodynamic losses is provided when the propeller is in use. The tapered hub housing (6) is fixed by securing the tapered housing bolts (12) passed through the tapered housing bolt bores (6.1) formed thereon to the tapered securing bores (7.4) formed on the connection collar (7).

This completes the description of the preferred and alternate embodiments of the invention. Those skilled in the art may recognize other equivalents to the specific embodiment described herein which equivalents are intended to be encompassed by the claims attached hereto.

What is claimed is:

1. A marine propeller arrangement comprising a propeller communicating with a shaft connected to a motor of a marine vehicle, the propeller having a hub and demountable blades, wherein each blade comprises a hub portion being integral therewith and each hub portion of each blade having plurality of bores for connecting thereof; and the arrangement comprises a sleeve having a shaft receiving bore, wherein each hub portion is supported by the sleeve and secured thereto via a plurality of securing elements, wherein the sleeve comprises a cylindrical portion to which each hub portion is secured, and a cylindrical hub supporting portion extending axially from the cylindrical portion, wherein each hub portion is seated on the cylindrical hub supporting portion, and wherein the cylindrical portion of the sleeve comprises a circular sleeve protrusion being coaxial thereto and extending axially along the hub supporting portion.

2. The marine propeller arrangement according to claim 1, wherein the marine vehicle shaft comprises a tapered portion, and the shaft receiving bore comprises a tapered form compatible with the shaft tapered portion for fitting the sleeve on the tapered portion.

3. The marine propeller arrangement according to claim 1, wherein each hub portion comprises a first mating surface, and a second mating surface, wherein the mating surfaces are arcuate and oppositely extend along the lateral surfaces of the hub portion.

4. The marine propeller arrangement according to claim 3, wherein the first mating surface is provided with protrusions extending outwardly from the surface, and the second mating surface is provided with recesses extending inwardly from the surface.

5. The marine propeller arrangement according to claim 4, wherein each hub portion comprises a hub recess extending circumferentially in the shaft radial direction.

6. The marine propeller arrangement according to claim 5, further comprising hub securing bores linearly formed parallel to the shaft axis along the hub portion starting from the surface of each hub recess.

7. The marine propeller arrangement according to claim 1, further comprising sleeve securing bores extending along the thickness of the cylindrical portion of the sleeve.

8. The marine propeller arrangement according to claim 7, further comprising mass balancing openings extending along the thickness of the sleeve cylindrical portion.

9. The marine propeller arrangement according to claim 1, further comprising a cylindrical collar supporting portion formed on the end portion of the hub supporting portion of the sleeve; and a connection collar fitted on said cylindrical collar supporting portion.

10. The marine propeller arrangement according to claim 9, wherein the connection collar comprises circular connection collar protrusions protruding axially on both opposing circular surfaces thereof; and connection collar bores extending along the thickness of the connection collar.

11. The marine propeller arrangement according to claim 1, wherein each hub portion comprises three securing bores for securing thereof by means of three separate hub securing elements.

12. The marine propeller arrangement according to claim 11, wherein at least one common securing element secures more than one hub portion.

* * * * *